US008186118B2

(12) United States Patent
Neuhofer

(10) Patent No.: US 8,186,118 B2
(45) Date of Patent: May 29, 2012

(54) COVERING DEVICE FOR FLOOR COVERINGS

(76) Inventor: Franz jun. Neuhofer, Zell am Moos (AT)

( * ) Notice: Subject to any disclaimer, the term of this patent is extended or adjusted under 35 U.S.C. 154(b) by 216 days.

(21) Appl. No.: 10/590,951

(22) PCT Filed: Jan. 25, 2005

(86) PCT No.: PCT/AT2005/000016

§ 371 (c)(1),
(2), (4) Date: Nov. 8, 2006

(87) PCT Pub. No.: WO2005/083195

PCT Pub. Date: Sep. 9, 2005

(65) Prior Publication Data

US 2008/0034696 A1 Feb. 14, 2008

(30) Foreign Application Priority Data

Feb. 27, 2004 (AT) ..... A 317/2004

(51) Int. Cl.
*E04C 3/00* (2006.01)
*E04D 1/36* (2006.01)

(52) U.S. Cl. ..... 52/465; 52/312

(58) Field of Classification Search ..... 52/465–468, 52/459, 312
See application file for complete search history.

(56) References Cited

U.S. PATENT DOCUMENTS 3,543,326 A 12/1970 Rohrberg et al.
3,665,666 A * 5/1972 Delcroix ..... 52/461
3,667,177 A 6/1972 Biela
4,067,155 A * 1/1978 Ruff et al. ..... 52/105
4,736,563 A 4/1988 Bilhorn
4,893,449 A * 1/1990 Kemper ..... 52/464
5,638,653 A 6/1997 Rossi et al.
5,657,598 A * 8/1997 Wilbs et al. ..... 52/287.1
6,230,385 B1 * 5/2001 Nelson ..... 29/450
6,345,480 B1 * 2/2002 Kemper et al. ..... 52/395
6,517,935 B1 * 2/2003 Kornfalt et al. ..... 428/331
6,550,192 B1 * 4/2003 Nelson et al. ..... 52/177
6,550,205 B2 * 4/2003 Neuhofer, Jr. ..... 52/464
6,588,165 B1 * 7/2003 Wright ..... 52/506.05
6,745,534 B2 * 6/2004 Kornfalt ..... 52/468
6,860,074 B2 * 3/2005 Stanchfield ..... 52/464
D504,181 S * 4/2005 Stanchfield ..... D25/119
6,898,911 B2 * 5/2005 Kornfalt et al. ..... 52/395
7,065,931 B2 * 6/2006 Kornfalt et al. ..... 52/395
7,150,134 B2 12/2006 Kornfalt et al.
7,207,143 B2 * 4/2007 Stanchfield ..... 52/459

(Continued)

FOREIGN PATENT DOCUMENTS

EP 1 113 124 7/2002

(Continued)

*Primary Examiner* — Eileen D Lillis
*Assistant Examiner* — Andrew Triggs
(74) *Attorney, Agent, or Firm* — Collard & Roe, P.C.

(57) ABSTRACT

A profiled cover for floor covering is made from an extruded profile and has a covering flange and at least one clamping web which protrudes downward from the covering flange, extends in the longitudinal direction of the profiled cover, and is used for fastening the profiled cover in a fixture. The cover also comprises a compensating strip fastened to the profiled cover by means of a form-fitting tongue and groove joint. The tongue and groove joint is formed by at least one longitudinal groove in an underside of the covering flange for retaining a tongue in the compensating strip, all sections of the covering flange lying flat over the floor covering they cover.

5 Claims, 5 Drawing Sheets

U.S. PATENT DOCUMENTS

| | | | | |
|---|---|---|---|---|
| D542,939 | S * | 5/2007 | Neuhofer, Jr. | D25/136 |
| D542,941 | S * | 5/2007 | Neuhofer, Jr. | D25/136 |
| 7,287,357 | B2 * | 10/2007 | Gomez Insa | 52/464 |
| 2003/0154678 | A1 | 8/2003 | Stanchfield | |
| 2003/0159389 | A1 | 8/2003 | Kornfalt et al. | |

FOREIGN PATENT DOCUMENTS

| | | |
|---|---|---|
| EP | 1 310 613 | 5/2003 |
| GB | 2 304 365 | 3/1997 |
| WO | WO 99/01628 A1 | 1/1999 |
| WO | WO 03/040492 A1 | 5/2003 |

* cited by examiner

COVERING DEVICE FOR FLOOR COVERINGS

CROSS REFERENCE TO RELATED APPLICATIONS

Applicant claims priority under 35 U.S.C. §119 of Austrian Application No. A 317/2004 filed Feb. 27, 2004. Applicant also claims priority under 35 U.S.C. §365 of PCT/AT2005/000016 filed Jan. 25, 2005. The international application under PCT article 21(2) was not published in English.

FIELD OF THE INVENTION

The invention relates to a covering device for floor coverings with a profiled cover that is provided with one covering flange and at least one clamping web which protrudes downward from the covering flange, extends in the longitudinal direction of the profiled cover, and is used for fastening the profiled cover in a fixture. The invention also comprises a compensating strip that if required can be fastened to the underside of the covering flange my means of a form-fitting tongue and groove joint.

DESCRIPTION OF THE PRIOR ART

A known method for bridging steps or joints in floor coverings is disclosed in WO 99/01628 A1, wherein profiled covers for steps and joints are invisibly attached by means of fixtures. For this purpose, the fixtures consists of a profiled section with a flat horizontal fastening element on the floor side. Extending upward from this flat horizontal element are vertical fastening legs, between which the downwardly protruding clamping webs of the profiled cover are inserted and held in place. The metallic profiled cover forms a hollow cavity along the outer clamping web, allowing the section of the leg extending from the outer clamping web to bend so that the profiled cover can adapt to the specific difference in height between the floor surfaces requiring bridging by means of the angle of inclination.

However, such an adjustment for height differences with respect to the floor coverings being bridged requires the profiled covers to have the requisite flexural properties, which cannot always be taken for granted. Furthermore, hollow cavities in the vicinity of the outer clamping webs of the covering flange result in a perceptible reduction in the stability of the profiled cover. In order for a profiled cover to bridge the difference in height between two floor surfaces without the profiled cover bending, a compensating strip has been proposed (WO 03/040492 A1) to be arranged under the profiled cover on the side with the lower floor, with said strip having an undercut groove for fastening it to the underside of the covering flange of the profiled cover. A retaining lug on the underside of the covering flange and parallel to the clamping web of the profiled cover engages with this groove in a form-fitting manner. The disadvantage of this known covering device for floor coverings is primarily that the groove and the lug of the tongue-and-groove joint between the profiled cover and the compensating strip have to be machined from the timber material of these components with great effort and that it is virtually impossible to obtain a snug fit between the profiled cover and the compensating strip due to the unavoidable production tolerances used in manufacturing the profiled cover and the compensating strip. Moreover, the profiled cover can only be used without a compensation strip as a cover for an expansion joint between two level floor coverings if the lug on the underside of the covering flange is removed beforehand.

SUMMARY OF THE INVENTION

Consequently, the object of the invention is to develop a covering device for floor coverings of the aforementioned type that is able to fulfil the requirements for the exact fit of a profiled cover and compensation strip while still being simple to manufacture.

The invention fulfils the object in that the profiled cover developed from an extruded profile has a tongue and groove joint formed by at least one longitudinal groove for retaining a lug of a compensating strip also developed from an extruded profile.

Developing the profiled cover and the compensating strip as an extruded profile manufactured by means of extrusion makes it possible to produce longitudinal grooves and the retaining lugs engaging in them to create tongue-and-groove joints of small dimensions, even subject to the constraints of series production, with a high degree of manufacturing precision, such that the longitudinal groove of the tongue and groove joint can be arranged in the covering flange of the profiled cover, without compromising the requisite stability of the profiled cover. The absence of retaining lugs on the underside of the covering flange makes it possible to use the profiled cover to cover the expansion joint between sections of floor on the same level without having to perform additional work on the profiled cover. In this case, the sections of the covering flange extending over each section of floor lie flat on the sections of floor so that the weakening of the covering flange due to the longitudinal grooves is of no consequence. If the profiled cover is used to bridge a difference in height between two floor surfaces in conjunction with a compensating strip, the compensating strip supported on the lower floor surface and connected to the profiled cover by means of the tongue and groove joint strengthens the covering flange accordingly such that the weakening of the covering flange due to the longitudinal grooves of the tongue and groove joint does not have any disadvantageous effects on such an application.

Although the form of the cross-section of the compensating strip can be designed in different ways, particularly simple manufacturing conditions are achieved when the compensating strip assumes the basic form of an angle section such that the leg with the retaining lug is adjacent to the underside of the covering flange of the profiled cover and the other forms an extension of the profiled cover extending downward. The leg of the angle section provided with the retaining lug therefore assists in transferring the load from the covering flange of the profiled cover to the leg of the angle section extending downward, which is supported on the lower floor surface.

For applications involving greater load requirements, the compensating strip can be provided with at least one additional supporting leg projecting downward from the leg with the retaining lug. It is also possible to connect the compensating strip to the fixture provided for accommodating the profiled cover by means of the supporting leg. To this end, the supporting leg of the compensating strip forms a coupling projection for connecting to the fixture for the profiled cover.

In order to join the compensating strip advantageously with the profiled cover, the compensating strip can be provided with a peripheral projection serving as a retaining lug in the area of the leg adjacent to the covering flange, with said projection engaging in a longitudinal groove serving as a retaining recess on the underside of the covering flange or on the side of the clamping web of the profiled cover facing the compensating strip, forming a pivot axis for the compensating strip. Consequently, to join the compensating strip to the profiled cover, the compensating strip with the peripheral projection only needs to be inserted into the corresponding retaining recess in the area of the covering flange or the clamping web in order to swivel the compensating strip around this peripheral projection serving as a pivot point against the underside of the covering flange until a retaining lug on the compensating strip engages in a corresponding longitudinal groove of the covering flange. Instead of a retaining lug on the leg, the leg of the compensating strip adjacent to the covering flange can also be provided with an adhesive surface on the side facing the covering flange by means of which the compensating strip is fastened to the underside of the covering flange. By anchoring the peripheral projection of the compensating strip in the corresponding retaining recess of the profiled cover, the torque resulting from the load of the profiled cover impinging on compensating strip can be reliably transferred, without having to worry about the compensating strip coming loose from the profiled cover.

The profiled cover and the compensating strip can be manufactured separately. However, particularly advantageous manufacturing conditions result when firstly an extruded profile is produced, the cross-section of which consists of the cross-sections of the profiled cover and at least one compensating strip, with said strip being connected to the subsequent profiled cover by means of a connecting land serving as a spacer, and then the compensating strip is separated from the profiled cover with a separating cut through the connecting land. The simultaneous manufacture of the profiled cover and at least one compensating strip does not only offer advantages with respect to the tooling costs, but also facilitates conventional coating on the visible surfaces of the profiled cover and the compensating strip, as in this case the profiled cover and the compensating strip can be coated together in one process. To this end, the connecting land between the profiled cover and the compensating strip forms a transition surface joining the visible surfaces of the profiled cover and the compensating strip and the transition surface is coated together with the visible surfaces of the profiled cover and the compensating strip, before the connecting land is severed. Simultaneously coating the profiled cover and the compensating strip means that the structure and visual appearance of the coating of the profiled cover and the compensating strip do not differ. The difference between the coatings of the profiled cover and compensating strips can at the most involve changes occurring at the kerfs, changes that are visually negligible owing to the width of the land, which is preferably restricted to the width of the kerf.

BRIEF DESCRIPTION OF THE DRAWING

The drawing illustrates embodiments of the invention. In the drawing

DESCRIPTION OF THE PREFERRED EMBODIMENT

Figure 1:
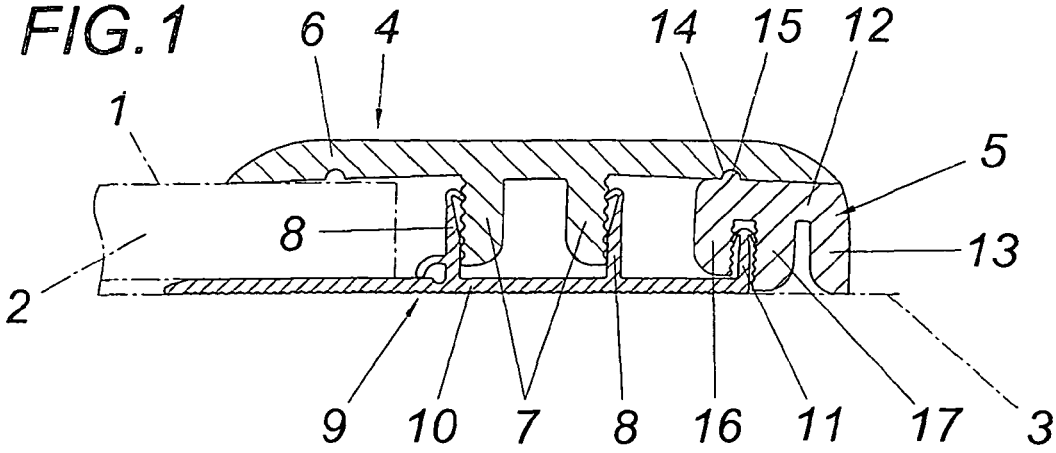
FIG. 1 shows a covering device in accordance with the invention in a simplified cross-section.

In accordance with the embodiment in FIG. 1, a difference in height between a floor surface 1, for instance a floor covering 2, and a floor surface 3 requires bridging, the latter surface in accordance with the embodiment being formed by the substrate for the floor covering 2. The floor surface 3 can of course also be formed by another floor covering. To bridge the difference in height between the floor surfaces 1 and 3, a covering device is used, comprising a profiled cover 4 and a compensating strip 5. The profiled cover 4 is provided with a covering flange 6 and two clamping webs 7 projecting from the covering flange 6, the clamping webs 7 being retained between two clamp-like retaining legs 8 of a fixture 9.

The fixture 9 is fastened to the substrate 3 by means of a floor mounting plate 10, with the floor mounting plate 10 being extended past the retaining legs 8 toward the compensating strip 5 and having an additional retaining leg 11 for the compensating strip 5. The extended section of the floor mounting plate with the retaining leg 11 could, if required, be separated by means of a predetermined breaking point, if there is no provision made for a compensating strip 5 or the compensating strip 5 does not require additional anchoring in the vicinity of the fixture 9.

The compensating strip 5, also developed from an extruded profile in the same manner as the profiled cover 4, displays the basic shape of a angle section with two legs 12 and 13. Of these legs, one rests against the underside of the covering flange 6 and the other flange [sic!] 13 forms a downward projecting extension of the profiled cover 4. In order to connect the compensating strip 5 to the profiled cover 4 provision is made for a tongue and groove joint comprising at least one longitudinal groove 14 in the covering flange 6 and at least one retaining lug 15 on the compensating strip 5. In addition, the compensating strip 5 is provided with a coupling projection 16 extending downward from the leg 12, which together with the retaining leg 11 of the fixture 9 provides for a clamping mount for the compensating strip 5. This means that the compensating strip 5 is not only connected to the profiled cover 4 by means of the tongue and groove joint 14, 15, but also to the fixture 9. The coupling projection 16 can serve in this case as a supporting leg 17 to help support the profiled cover 4 on the side of the lower floor surface 3 such that it is not only supported by the downward projecting leg 13 on the side of the lower floor surface 3. Accordingly, the difference in height between two floor surfaces 1 and 3 is bridged in an advantageous manner with the assistance of the compensating strip 5 in conjunction with a profiled cover 4 that is symmetrical with respect to a longitudinal middle plane, without impinging upon the use of the profiled cover 4 as a cover for an expansion joint in the vicinity of a floor covering that does not differ in height around the expansion joint.

Figure 11:
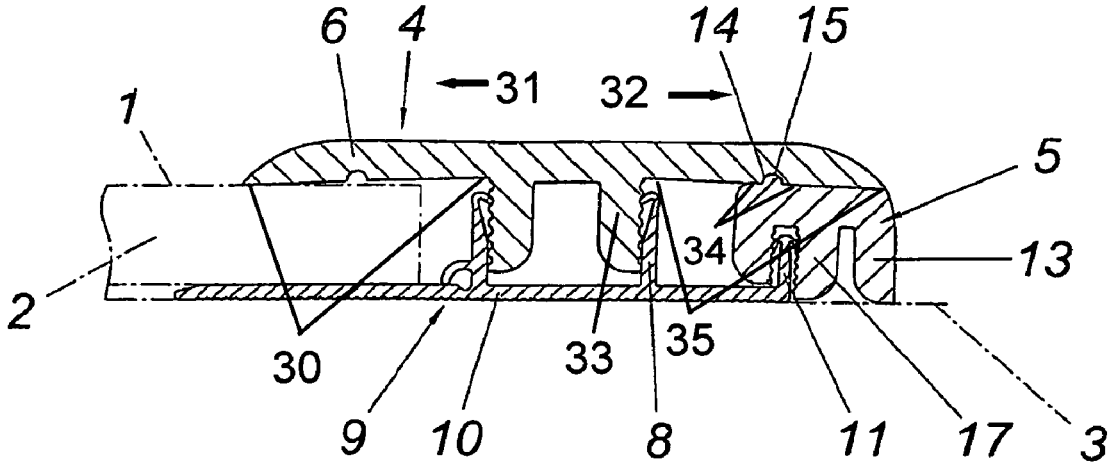
FIG. 11 shows the covering device shown in FIG. 1 with additional elements of the covering device labeled.

A first contact surface 35 on the underside of covering flange 6, in the area directly above and near the compensating strip 5, is labeled in FIG. 11. FIG. 11 shows that this first contact surface 35 includes all of the area on the underside of covering flange 6 between the two lines shown in FIG. 11 that extend from reference number 35. A second contact surface 30 on the underside of covering flange 6 in the area directly above and near floor covering 2 is also labeled in FIG. 11. FIG. 11 shows that the second contact surface 30 includes at least all of the area on the underside of covering flange 6 in between the two lines shown in FIG. 1 that extend from reference number 30.

A groove section 34 in the covering flange 6 is labeled in FIG. 11 and is a portion of the first contact surface 35. Groove section 34 includes longitudinal groove 14 and the flat areas of the underside of the covering flange 6 immediately adjacent the longitudinal groove 14, and is shown in FIG. 11 as including all of the area on the underside of covering flange 6 in between the two lines shown in FIG. 11 that extend from reference number 34.

FIG. 11 shows that the first contact surface 35 extends past the clamping web 33 in the direction to the right of the profiled cover 4 on a first side 32 of profiled cover 4. FIG. 11 also shows that the second contact surface 30 extends past this clamping web 33 on a second side 31 of the profiled cover 4 in the direction to the left of clamping web 33 of profiled cover 4.

Figure 2:
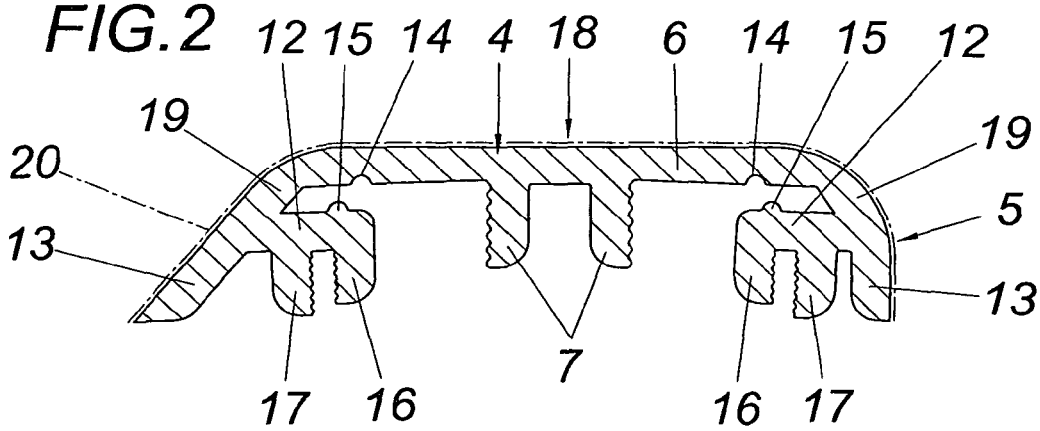
FIG. 2 shows an extruded profile for the combined manufacture of the profiled cover and two compensating strips for a covering device in accordance with the FIG. 1 in cross-section.
Figure 3:
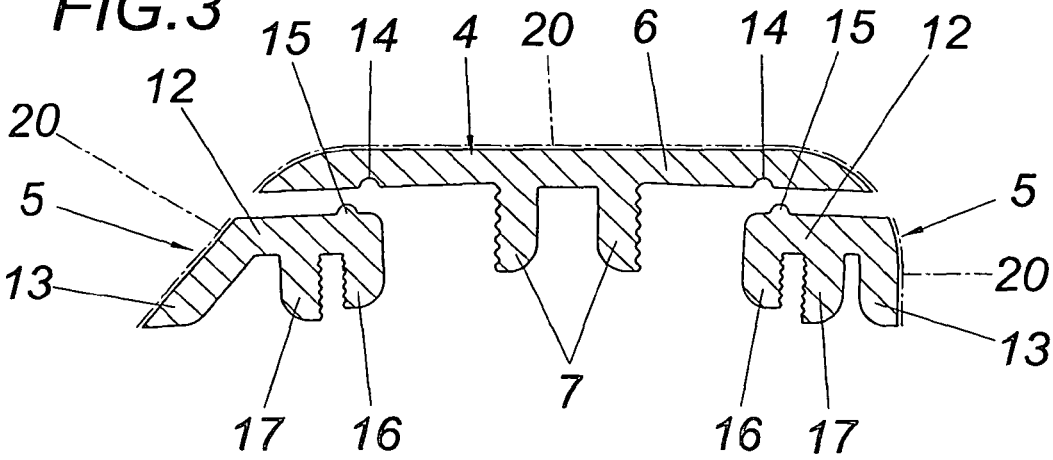
FIG. 3 shows the profiled cover with the compensating strips in cross-section after the lands have been severed.

As can be seen in FIG. 2, the profiled cover 4 can be manufactured from a common extruded profile 18 together with two optionally utilised and differently designed compensating strips 5. The cross-section of the extruded profile 18 is constituted by the cross-sections of the profiled cover 4 and the compensating strips 5 that are connected to the subsequent profiled cover 4 by means of a connecting land 19 serving as a spacer. If the visible surfaces of the profiled cover 4 and the compensating strips 3 [sic!] are coated, the common extruded profile 18 is provided with a coating 20 indicated by the dash-dotted line, with the connecting lands 19 forming transition surfaces between the visible surfaces of the profiled cover 4 and the compensating strips 5 for the coating 20. After the extruded profile 18 has been coated, the connecting lands 19 are severed with a single cut each, preferably with the width of the kerf corresponding to the gap between the covering flange 6 of the profiled cover 4 and the compensating strips 5. The compensating strips 5 separated from the profiled cover 4 can be seen in FIG. 3 with a bilateral arrangement corresponding to the extruded profile 18 used as the basis for the workpiece.

Figure 4:
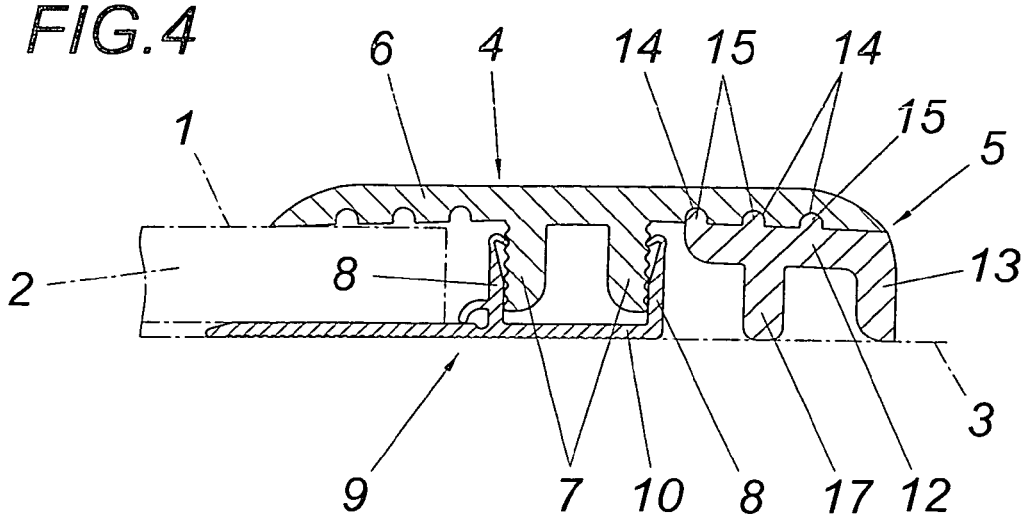
FIG. 4 shows a representation corresponding to FIG. 1 of a design variation for a covering device in accordance with the invention.

The covering device in accordance with FIG. 4 differs from the one in FIG. 1 essentially with respect to the differing shape of the profiled cover 4 and the compensating strip 5, which, without connection to the fixture 9, is only fastened to the underside of the covering flange 6 of the profiled cover 4 by means of a tongue and groove joint consisting of a plurality of longitudinal grooves 14 and retaining lugs 15. The compensating strip 5 is provided with a supporting leg 17 for additional support on the lower floor surface 3.

Figure 5:
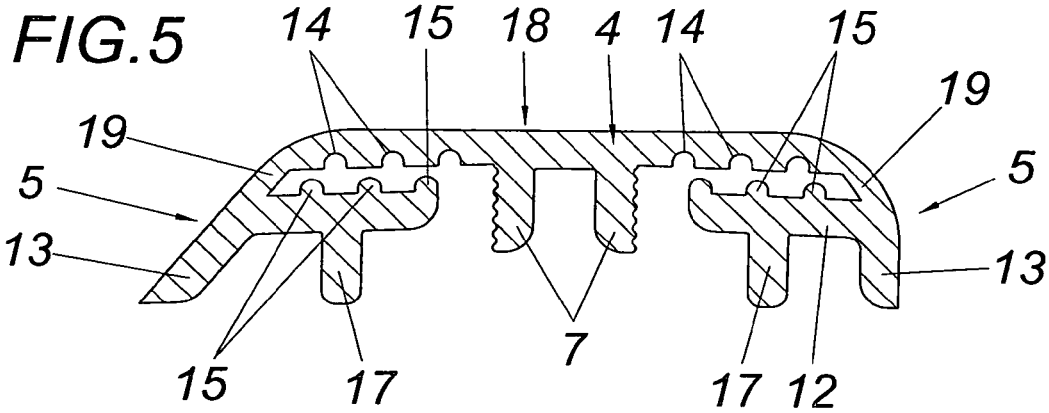
FIG. 5 shows an extruded profile for the combined manufacture of the profiled cover and two compensating strips for the covering device in accordance with FIG. 4 in cross-section, the FIGS. 6 to 9 show representations of extruded profiles corresponding to FIGS. 2 and 5 for differing profiled covers and compensating strips.

FIG. 5 shows that the profiled cover 4 with the corresponding compensating strips 5 in accordance with the covering device in FIG. 4 can also be manufactured from a common profiled section 18, with provision being made for connecting lands 19 as spacers between the profiled cover 4 and the compensating strips 5. By severing these connecting lands 19, the extruded profile 18 separates into the profiled cover 4 and the two compensating strips 5 which can be utilised if required.

Figure 6:
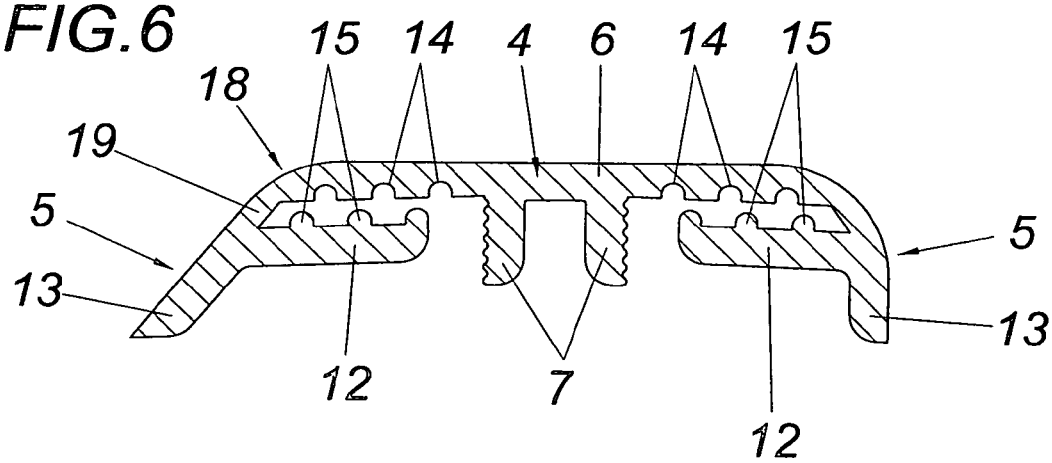
Figure 7:
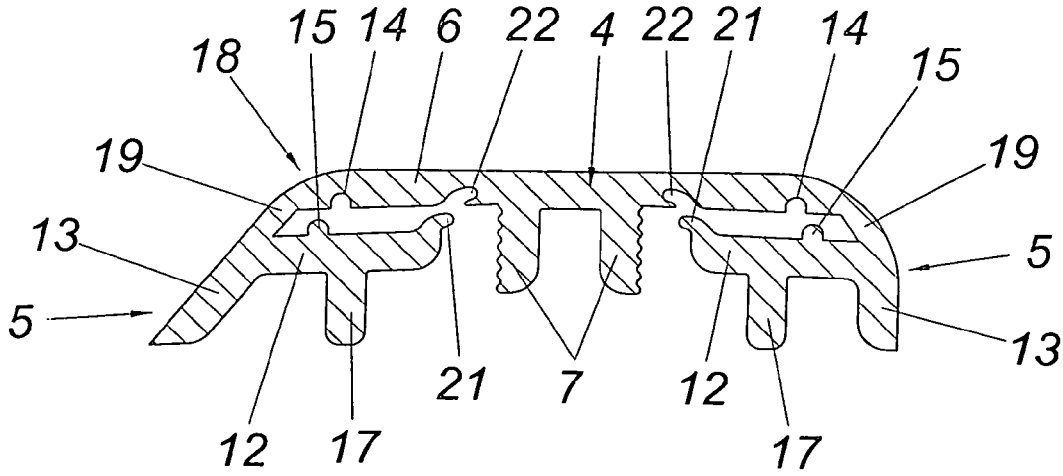
Figure 8:
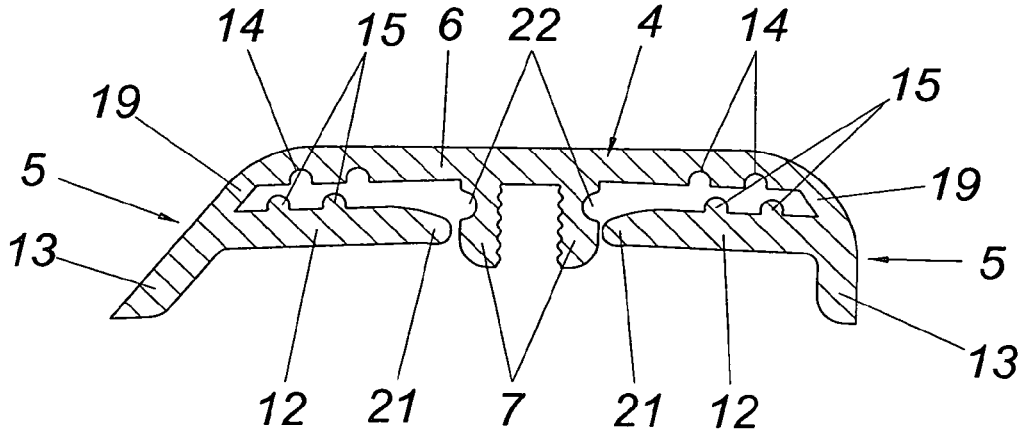

FIG. 6 to 8 show further embodiments of profiled covers 4 and compensating strips 5. In contrast with FIG. 5, the compensating strips 5 in FIG. 6 are developed without supporting legs 17.

According to FIGS. 7 and 8, the compensating strips 5 have peripheral projections 21 on the legs 12 to serve as retaining lugs, which in accordance with FIG. 7 engage in longitudinal grooves 22 serving as retaining recesses on the underside of the covering flange 6, but which in accordance with FIG. 8 engage in longitudinal grooves 22 provided on the side of the clamping webs 7 facing each of the compensating strips 5. This means that one or two retaining legs 8 of the fixture 9 must encompass the clamping webs 7 to ensure free access to the retaining recesses 22. The peripheral projections 21 engaging in the retaining recesses 22 form pivot axes for the compensating strips 5, which are pivoted around the peripheral projections 21 until the retaining lugs 15 engage in the longitudinal grooves 14 and the leg 12 of the compensating strips 5 lies flat on the underside of the covering leg [sic!] 6. This engagement of the compensating strips 5 with the profiled cover 4 creates a joint between the covering strips 5 [sic!] and the profiled covers 4 by means of which the resultant torque loads to which the compensating strips 5 supported on the floor surface 3 by the leg 13 or the supporting leg 17 are subjected are transferred without the risk of the tongue and groove joint releasing.

Figure 9:
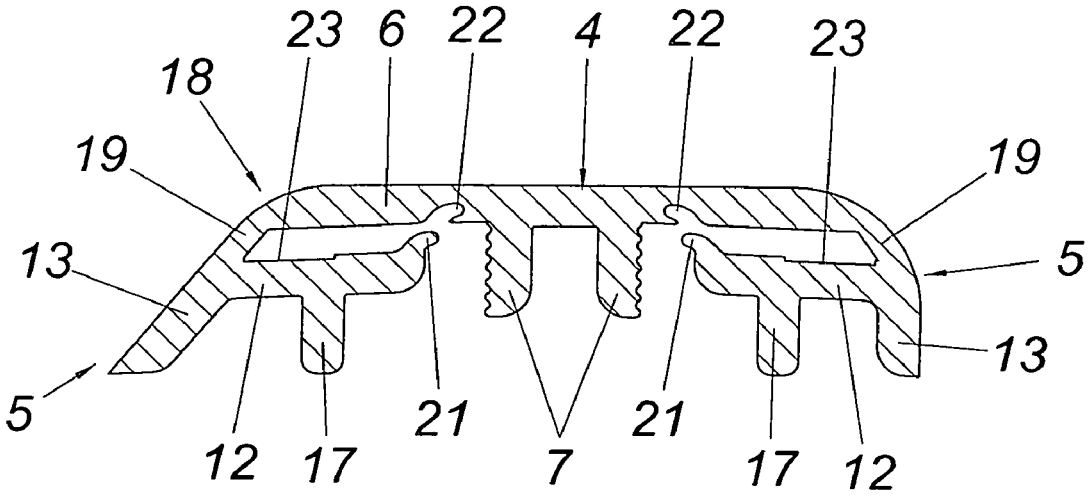
Figure 10:
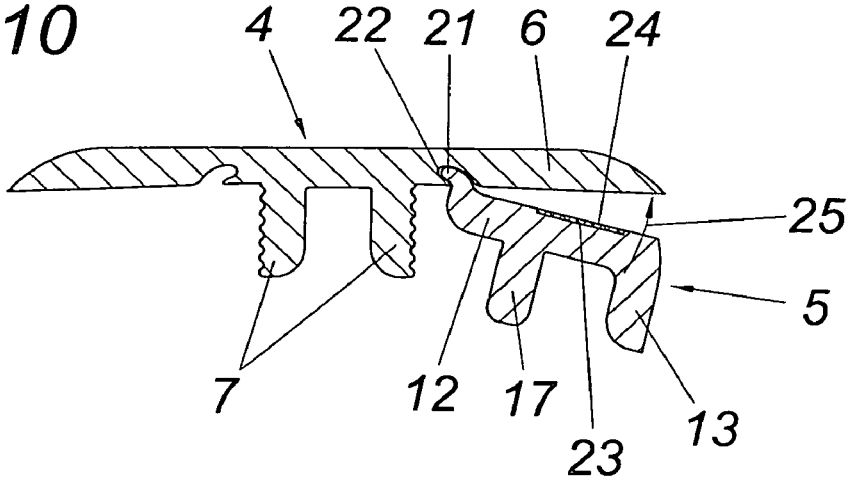
FIG. 10 shows a profiled cover with a compensating strip in accordance with FIG. 9 in an interim installation position in cross-section.

The compensating strips 5 in accordance with FIGS. 9 and 10 correspond in essence to those in FIG. 7. However, in contrast with the compensating strips 5 in FIG. 7, the compensating strips 5 in FIGS. 9 and 10 do not have a retaining lug 15 on the side of the leg 12 facing the covering flange 6 of the profiled cover 4. In fact, the leg 12 has a recess 23 for accommodating an adhesive strip 24, the adhesive surface of which firmly holds the compensating strip 5 to the underside of the covering flange 6 when the compensating strip 5 is pivoted around the pivot point provided by peripheral projection 21 against the underside of the covering flange 6 after the peripheral projection 21 is inserted into the longitudinal groove 22 as indicated in FIG. 10 by the arrow 25.

The invention claimed is:

1. A floor covering device comprising:

(a) a profiled cover made of an extruded profile, the profiled cover comprising a covering flange and at least one clamping web protruding downward from the covering flange and extending in a longitudinal direction of the profiled cover;

wherein the covering flange comprises an underside comprising a first contact surface, a second contact surface, a groove section in the first contact surface, and at least one longitudinal groove in the groove section, the first contact surface extending past the at least one clamping web on a first side of the profiled cover and the second contact surface extending past the at least one clamping web on a second side of the profiled cover; and (b) a compensating strip comprising a tongue and fastened to the covering flange;

wherein the at least one longitudinal groove of the profiled cover and the tongue of the compensating strip form a tongue-and-groove joint fastening the compensating strip to the covering flange as the tongue projects into the at least one longitudinal groove and the at least one longitudinal groove retains the tongue;

wherein the groove section is supported flat over the compensating strip;

wherein the first contact surface is supported flat over the compensating strip, wherein the second contact surface can be supported flat over a floor cover segment; and wherein the compensating strip is provided with a peripheral projection on a leg adjacent to the covering flange to serve as a retaining lug, said peripheral projection engaging in a second longitudinal groove serving as a retaining recess on the underside of the covering flange or on a side of the at least one clamping web of the profiled cover facing the compensating strip, wherein the engaging forms a pivot axis for the compensating strip.

2. The floor covering device in accordance with claim 1, wherein the compensating strip has the basic form of an angle section with two legs, the leg with the tongue being adjacent to the underside of the covering flange of the profiled cover and the other leg forming an extension of the profiled cover extending downward.

3. The floor covering device in accordance with claim 2, wherein the compensating strip is provided with at least one supporting leg projecting from the leg with the tongue.

4. The floor covering device in accordance with claim 3, wherein the at least one supporting leg of the compensating strip forms a coupling projection.

5. The floor covering device in accordance with claim 1, wherein the leg of the compensating strip adjacent to the covering flange is provided with an adhesive surface on the side of the at least one clamping web facing the covering flange.

* * * * *